US009601070B2

(12) United States Patent
Liu et al.

(10) Patent No.: US 9,601,070 B2
(45) Date of Patent: Mar. 21, 2017

(54) METHOD FOR PERFORMING DETECTION ON DISPLAY PANEL

(71) Applicant: Shenzhen China Star Optoelectronics Technology Co., Ltd., Shenzhen (CN)

(72) Inventors: Huan Liu, Shenzhen (CN); JinJie Wang, Shenzhen (CN)

(73) Assignee: Shenzhen China Star Optoelectronics Technology Co., Ltd., Shenzhen (CN)

( * ) Notice: Subject to any disclaimer, the term of this patent is extended or adjusted under 35 U.S.C. 154(b) by 61 days.

(21) Appl. No.: 14/417,151

(22) PCT Filed: Nov. 28, 2014

(86) PCT No.: PCT/CN2014/092500
§ 371 (c)(1),
(2) Date: Jan. 25, 2015

(87) PCT Pub. No.: WO2016/082190
PCT Pub. Date: Jun. 2, 2016

(65) Prior Publication Data

US 2016/0148591 A1 May 26, 2016

(30) Foreign Application Priority Data

Nov. 24, 2014 (CN) ..... 2014 1 0680359

(51) Int. Cl.
*G09G 3/36* (2006.01)
*G09G 3/00* (2006.01)

(52) U.S. Cl.
CPC ..... *G09G 3/3648* (2013.01); *G09G 3/006* (2013.01)

(58) Field of Classification Search
CPC ..... G09G 3/3696; G09G 2320/0233; G09G 3/3648; G09G 3/006
See application file for complete search history.

(56) References Cited

U.S. PATENT DOCUMENTS

| | | | | |
|---|---|---|---|---|
| 2004/0207018 | A1 | 10/2004 | Jang et al. | |
| 2005/0204219 | A1 | 9/2005 | Taguchi et al. | |
| 2006/0145996 | A1 | 7/2006 | Chang | |
| 2011/0068048 | A1 | 3/2011 | Cao et al. | |
| 2013/0044090 | A1* | 2/2013 | Wu | G02F 1/136213 345/204 |
| 2015/0022510 | A1 | 1/2015 | Yao et al. | |
| 2016/0124279 | A1 | 5/2016 | Yao et al. | |

FOREIGN PATENT DOCUMENTS

| | | | |
|---|---|---|---|
| CN | 1800926 | A | 7/2006 |
| CN | 102033372 | A | 4/2011 |
| CN | 102043292 | A * | 5/2011 |
| CN | 10353698 | A | 10/2013 |
| CN | 103513484 | A | 1/2014 |

* cited by examiner

*Primary Examiner* — Alexander Eisen
*Assistant Examiner* — Abhishek Sarma
(74) *Attorney, Agent, or Firm* — JMB Davis Ben-David

(57) ABSTRACT

A detection circuit of a display panel and a detection method thereof are disclosed. The detection circuit includes two detection lines respectively for providing scan signals for each row of pixel units. One of the detection lines is only connected to one scan line of the pixel unit and the other one of the detection lines is connected to another scan line of the pixel unit. By way of connecting two scan lines of the pixel unit to different detection lines and applying different voltages respectively thereto, the present invention can detect abnormalities of the display panel.

14 Claims, 7 Drawing Sheets

METHOD FOR PERFORMING DETECTION ON DISPLAY PANEL

CROSS-REFERENCE TO RELATED APPLICATIONS

This is the U.S. National Stage of International Application No. PCT/CN2014/092500, filed Nov. 28, 2014, which in turn claims the benefit of China Patent Application No. 201410680359.8, filed Nov. 24, 2014.

BACKGROUND OF THE INVENTION

1. Field of the Invention

The present invention relates to a display technology, and more particularly, to a detection circuit of a display panel and a method for performing detection on the display panel by using the detection circuit.

2. Description of Prior Art

The existing display panel includes a plurality of pixel units. Each pixel unit includes a pixel main portion and a pixel sub portion. In order to solve the problem of color deviation for large-angle viewing, it is commonly configured that the brightness of the pixel main portion is higher than that of the pixel sub portion, thereby improving the display effect. The pixel main portion has a first thin film transistor and the pixel sub portion has a second thin film transistor and a third thin film transistor. A primary scan line is connected to control terminals of the first thin film transistor and the second thin film transistor. When the primary scan line is inputted with a high voltage level, the first thin film transistor and the second thin film transistor are turned on, the pixel main portion and the pixel sub portion are charged with electricity by data lines, and the charges of the pixel main portion and the pixel sub portion are equal to each other after the charging is accomplished. A secondary scan line is connected to the control terminal of the third thin film transistor. When the secondary scan line is inputted with the high voltage level, the third thin film transistor is turned on, and a part of charges of a liquid crystal capacitor of the pixel sub portion is distributed to a share capacitor such that the charges of the pixel sub portion is less than that of the pixel main portion, thereby solving the problem of color deviation for large-angle viewing.

As shown in FIG. 1, a conventional detection circuit 1 includes a first detection line 11, a second detection line 12, and pixel units 15. Each scan line corresponding to the pixel unit includes a primary scan line 13 and a secondary scan line 14. The primary scan lines of odd rows (1, 3, 5, 7) of the pixel units are connected to the first detection line 11. The primary scan lines of even rows (2, 4, 6, 8) of the pixel units are connected to the second detection line 12. Also, the primary scan line of the (n+2)th row of the pixel units is connected to the secondary scan line of the (n)th row of the pixel units. Alternatively, as shown in FIG. 2, the primary scan line of the (n+4)th row of the pixel units is connected to the secondary scan line of the (n)th row of the pixel units. Other connections in FIG. 2 are similar to FIG. 1, where n is a positive integer. The conventional detection circuit only can detect whether or not the pixel main portion and the pixel sub portion are illuminated.

However, there are ITO (a transparent conductive layer) residues existed between the share capacitor and a pixel electrode of the pixel sub portion in the manufacture. Accordingly, a short may occur between the share capacitor and the pixel electrode of the pixel sub portion, and therefore controlling the third thin film transistor is not possible.

When the pixel electrode of the pixel sub portion is charged with electricity, the share capacitor is also charged such that the voltages of them are identical to each other. When the pixel electrode of the pixel sub portion is accomplished in charging, the voltages of the pixel electrode of the pixel sub portion and an upper electrode of the share capacitor are the same such that the liquid crystal capacitor of the pixel sub portion cannot share a part of charges with the share capacitor, the voltage of the pixel sub portion cannot be lowered, and the brightness of the pixel sub portion becomes abnormal. That is, the display panel is abnormal. This abnormal circumstance is more apparent particularly under low gray levels (e.g., L48 gray level). Therefore, it is necessary to detect abnormalities of the display panel. The conventional detection circuit cannot detect the abnormalities of the display panel.

Therefore, there is a need to provide a detection circuit of a display panel and a method for performing detection on the display panel by using the detection circuit, for solving the problems in conventional skills.

SUMMARY OF THE INVENTION

The objective of the present invention is to provide a detection circuit of a display panel and a method for performing detection on the display panel by using the detection circuit, for solving the technical problem of abnormalities on the display panel, which cannot be detected by a conventional detection circuit, thereby improving the display effect.

To solve the above problems, the technical schemes of the present invention are provided below.

An embodiment of the present invention provides a detection circuit of a display panel, which comprises an array substrate, said array substrate comprising: data lines, scan lines, a plurality of pixel units defined by the data lines and the scan lines, the plural pixel units forming a plurality of rows of pixel units, a scan line corresponding to the pixel units comprising a primary scan line and a secondary scan line; wherein each pixel unit comprises a pixel main portion and a pixel sub portion, the pixel main portion has a first thin film transistor, the pixel sub portion has a second thin film transistor and a third thin film transistor, the primary scan line is used to input a first scan signal into control terminals of the first thin film transistor and the second thin film transistor, the first scan signal is used to control input of data signals to input terminals of the first thin film transistor and the second thin film transistor, an output terminal of the first thin film transistor is connected to a main liquid crystal capacitor of the pixel main portion, an output terminal of the second thin film transistor is connected to a sub liquid crystal capacitor of the pixel sub portion; and wherein the secondary scan line is used to input a second scan signal into the control terminal of the third thin film transistor when the first thin film transistor is disconnected from the second thin film transistor, the second scan signal is used to redistribute charges of the sub liquid crystal capacitor and a share capacitor, the input terminal of the third thin film transistor is connected to the sub liquid crystal capacitor of the pixel sub portion, the output terminal of the third thin film transistor is connected to the share capacitor; the detection circuit comprising: two detection lines respectively providing scan signals for each row of the pixel units; wherein one of the detection lines is only connected to one scan line of the pixel units and the other one of the detection lines is connected to another scan line of the pixel units.

The present invention also provides a method for performing detection on a display panel by using said detection circuit, wherein the two detection lines comprise a first detection line and a second detection line, said method comprising: dividing the plural rows of pixel units into n sets of detection regions, each set of the detection regions comprising h rows of pixel units, the primary scan line of each row of the pixel units in a (2n+1)th set of the detection regions being connected to the first detection line, the primary scan line of each row of the pixel units in a (2n)th set of the detection regions being connected to the second detection line, the secondary scan line of each row of the pixel units in a (n)th set of the detection regions being connected to the primary scan line of any row of the pixel units in a (n+1)th set of the detection regions, where n is a positive integer, h=2k, k≥1; inputting a high voltage level to the first detection line and inputting a low voltage level to the second detection line such that the first thin film transistor and the second thin film transistor of each row of the pixel units in the (2n+1)th set of the detection regions are turned on and the third thin film transistor of each row of the pixel units in the (2n+1)th set of the detection regions is turned off; inputting a first data signal to each row of the pixel units in the (2n+1)th set of the detection regions by using the data lines so as to charge the pixel sub portion of each row of the pixel units in the (2n+1)th set of the detection regions; after the step of inputting the first data signal to each row of the pixel units in the (2n+1)th set of the detection regions by using the data lines, said method further comprising: inputting the low voltage level to the first detection line and inputting the high voltage level to the second detection line such that the first thin film transistor and the second thin film transistor of each row of the pixel units in the (2n+1)th set of the detection regions are turned off and the third thin film transistor of each row of the pixel units in the (2n+1)th set of the detection regions is turned on; inputting a second data signal to each row of the pixel units in the (2n)th set of the detection regions by using the data lines so as to check whether or not the brightness of the pixel sub portion of each row of the pixel units in the (2n+1)th set of the detection regions is abnormal and produce a detection result; inputting the high voltage level to the second detection line and inputting the low voltage level to the first detection line such that the first thin film transistor and the second thin film transistor of each row of the pixel units in the (2n)th set of the detection regions are turned on and the third thin film transistor of each row of the pixel units in the (2n)th set of the detection regions is turned off; inputting the first data signal to each row of the pixel units in the (2n)th set of the detection regions by using the data lines so as to charge the pixel sub portion of each row of the pixel units in the (2n)th set of the detection regions; after the step of inputting the first data signal to each row of the pixel units in the (2n)th set of the detection regions by using the data lines, said method further comprising: inputting the low voltage level to the second detection line and inputting the high voltage level to the first detection line such that the first thin film transistor and the second thin film transistor of each row of the pixel units in the (2n)th set of the detection regions are turned off and the third thin film transistor of each row of the pixel units in the (2n)th set of the detection regions is turned on; inputting the second data signal to each row of the pixel units in the (2n+1)th set of the detection regions by using the data lines so as to check whether or not the brightness of the pixel sub portion of each row of the pixel units in the (2n)th set of the detection regions is abnormal and produce a detection result; wherein the voltage of the first data signal is larger than that of the second data signal.

In the method for performing detection on the display panel by using said detection circuit in accordance with the present invention, the brightness of the pixel sub portion is compared with a predetermined brightness threshold to produce the detection result.

In the method for performing detection on the display panel by using said detection circuit in accordance with the present invention, the brightness of the pixel sub portion is abnormal when the detection result indicates that the brightness of the pixel sub portion is greater than the predetermined brightness threshold.

In the method for performing detection on the display panel by using said detection circuit in accordance with the present invention, the brightness of the pixel sub portion is normal when the detection result indicates that the brightness of the pixel sub portion is less than or equal to the predetermined brightness threshold.

The present invention further provides a method for performing detection on a display panel by using said detection circuit, wherein the two detection lines comprise a first detection line and a second detection line, said method comprising: dividing the plural rows of pixel units into n sets of detection regions, each set of the detection regions comprising h rows of pixel units, the primary scan line of each row of the pixel units in a (2n+1)th set of the detection regions being connected to the second detection line, the primary scan line of each row of the pixel units in a (2n)th set of the detection regions being connected to the first detection line, the secondary scan line of each row of the pixel units in a (n)th set of the detection regions being connected to the primary scan line of any row of the pixel units in a (n+1)th set of the detection regions, where n is a positive integer, h=2k, k≥1.

In the method for performing detection on the display panel by using said detection circuit in accordance with the present invention, said method further comprises: inputting a high voltage level to the second detection line and inputting a low voltage level to the first detection line such that the first thin film transistor and the second thin film transistor of each row of the pixel units in the (2n+1)th set of the detection regions are turned on and the third thin film transistor of each row of the pixel units in the (2n+1)th set of the detection regions is turned off; inputting a first data signal to each row of the pixel units in the (2n+1)th set of the detection regions by using the data lines so as to charge the pixel sub portion of each row of the pixel units in the (2n+1)th set of the detection regions; after the step of inputting the first data signal to each row of the pixel units in the (2n+1)th set of the detection regions by using the data lines, said method further comprising: inputting the low voltage level to the second detection line and inputting the high voltage level to the first detection line such that the first thin film transistor and the second thin film transistor of each row of the pixel units in the (2n+1)th set of the detection regions are turned off and the third thin film transistor of each row of the pixel units in the (2n+1)th set of the detection regions is turned on; and inputting a second data signal to each row of the pixel units in the (2n)th set of the detection regions by using the data lines so as to check whether or not the brightness of the pixel sub portion of each row of the pixel units in the (2n+1)th set of the detection regions is abnormal and produce a detection result; wherein the voltage of the first data signal is larger than that of the second data signal.

In the method for performing detection on the display panel by using said detection circuit in accordance with the present invention, said method further comprises: inputting a high voltage level to the first detection line and inputting a low voltage level to the second detection line such that the first thin film transistor and the second thin film transistor of each row of the pixel units in the (2n)th set of the detection regions are turned on and the third thin film transistor of each row of the pixel units in the (2n)th set of the detection regions is turned off; inputting a first data signal to each row of the pixel units in the (2n)th set of the detection regions by using the data lines so as to charge the pixel sub portion of each row of the pixel units in the (2n)th set of the detection regions; after the step of inputting the first data signal to each row of the pixel units in the (2n)th set of the detection regions by using the data lines, said method further comprising: inputting the low voltage level to the first detection line and inputting the high voltage level to the second detection line such that the first thin film transistor and the second thin film transistor of each row of the pixel units in the (2n)th set of the detection regions are turned off and the third thin film transistor of each row of the pixel units in the (2n)th set of the detection regions is turned on; inputting a second data signal to each row of the pixel units in the (2n+1)th set of the detection regions by using the data lines so as to check whether or not the brightness of the pixel sub portion of each row of the pixel units in the (2n)th set of the detection regions is abnormal and produce a detection result; wherein the voltage of the first data signal is larger than that of the second data signal.

In the method for performing detection on the display panel by using said detection circuit in accordance with the present invention, the brightness of the pixel sub portion is compared with a predetermined brightness threshold to produce the detection result.

In the method for performing detection on the display panel by using said detection circuit in accordance with the present invention, the brightness of the pixel sub portion is abnormal when the detection result indicates that the brightness of the pixel sub portion is greater than the predetermined brightness threshold.

In the method for performing detection on the display panel by using said detection circuit in accordance with the present invention, the brightness of the pixel sub portion is normal when the detection result indicates that the brightness of the pixel sub portion is less than or equal to the predetermined brightness threshold.

In the method for performing detection on the display panel by using said detection circuit in accordance with the present invention, the predetermined brightness threshold is an average of the brightness of the pixel sub portions of all the pixel units on the display panel.

By way of connecting two scan lines of a pixel unit to different detection lines and applying different voltages respectively thereto, the detection circuit of the display panel and the method for performing detection on the display panel by using said circuit in accordance with the present invention can detect abnormalities of the display panel and solve the technical problem of abnormalities on the display panel, which cannot be detected by a conventional detection circuit, thereby improving the display effect.

To make above content of the present invention more easily understood, it will be described in details by using preferred embodiments in conjunction with the appending drawings.

DETAILED DESCRIPTION OF THE PREFERRED EMBODIMENTS

The following descriptions for the respective embodiments are specific embodiments capable of being implemented for illustrating the present invention with reference to the appended drawings. For example, the terms such as "up", "down", "front", "rear", "left", "right", "interior", "exterior", and "side" mentioned in the present disclosure are merely directions referring to the appended drawings. Therefore, the wordings of these directions are employed for explaining and understanding the present invention but it is not limited thereto.

In the appended drawings, similar units are labeled with the same reference numbers.

Figure 3:
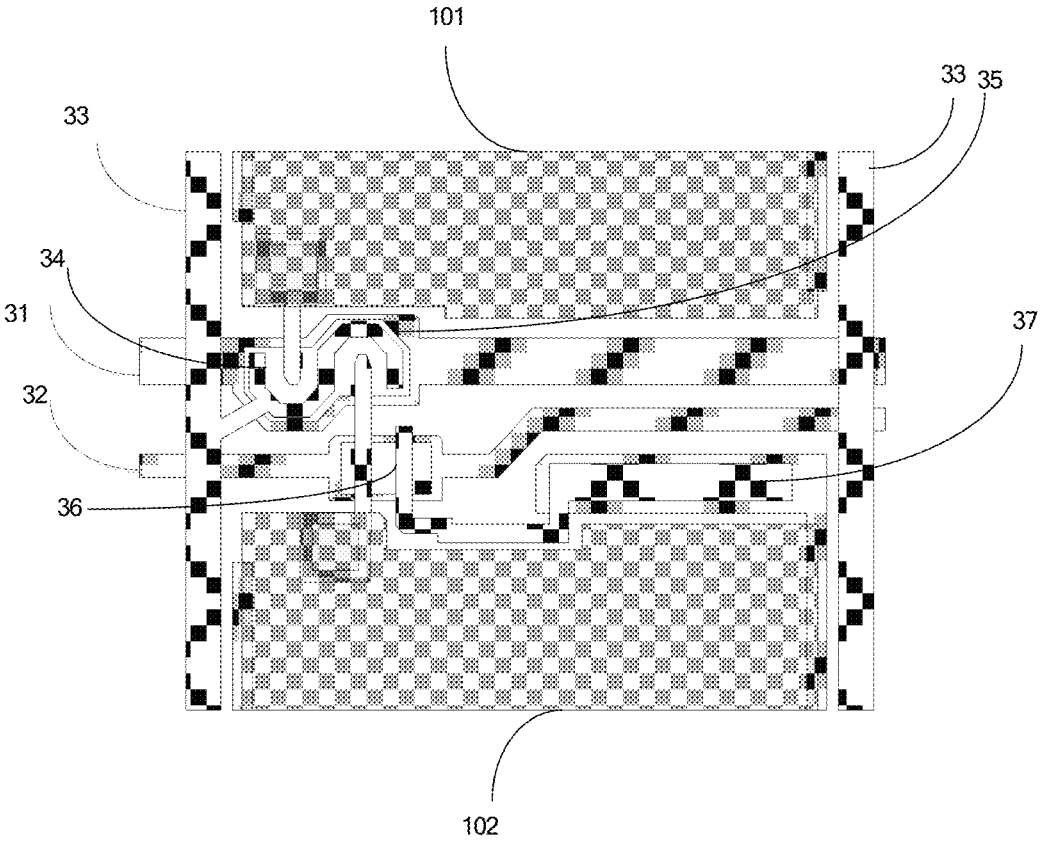
FIG. 3 a schematic structural diagram showing a liquid crystal display panel of the present invention.

Please refer to FIG. 3, which a schematic structural diagram showing a liquid crystal display panel of the present invention.

The liquid crystal display panel comprises an array substrate, a color filter substrate, and a liquid crystal layer disposed between the array substrate and the color filter substrate. The array substrate comprises data lines, scan lines, and a plurality of pixel units defined by the data lines and the scan lines. The plural pixel units form a plurality of rows of pixel units. The scan line corresponding to each of the pixel units comprises a primary scan line 31 and a secondary scan line 32.

Figure 1:
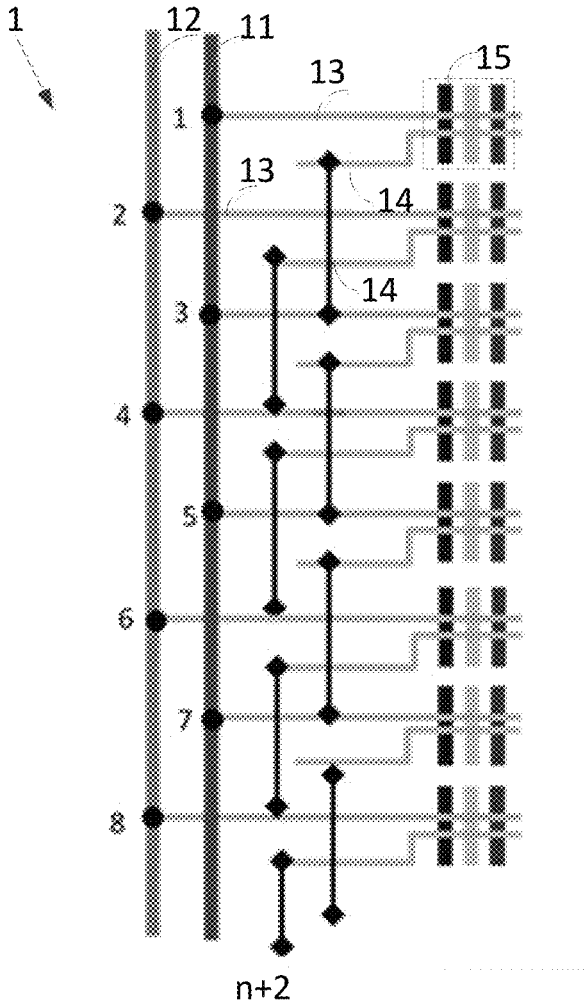
FIG. 1 is a schematic structural diagram showing a first detection circuit in conventional skills.
Figure 2:
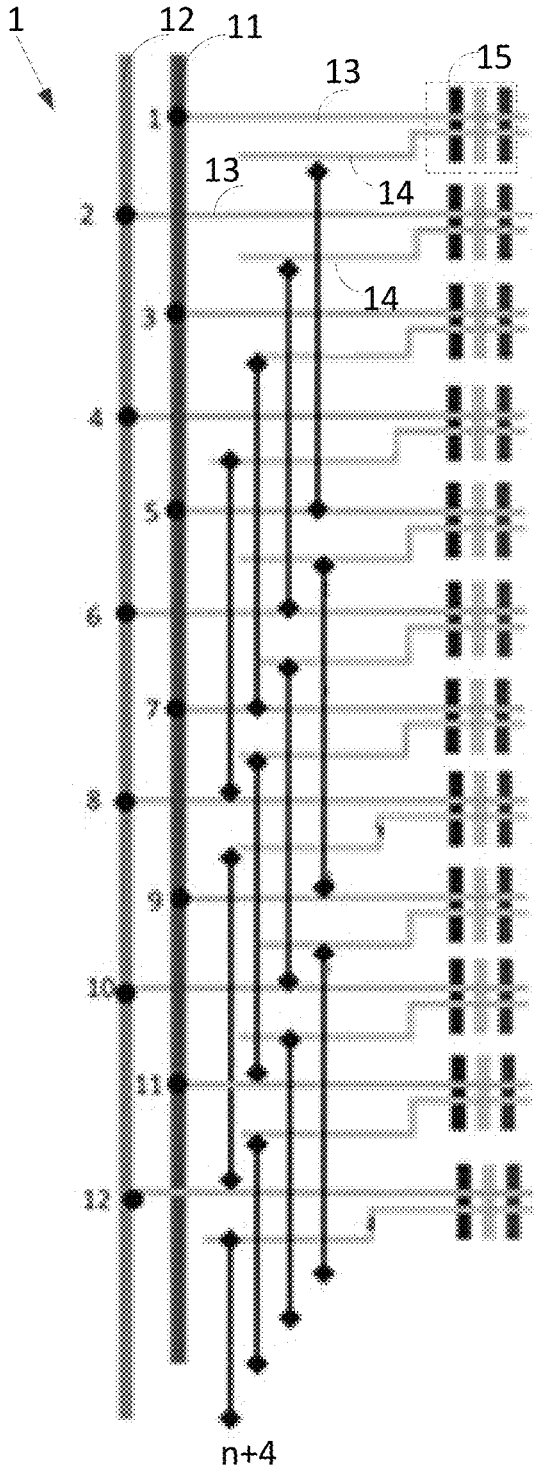
FIG. 2 is a schematic structural diagram showing a second detection circuit in conventional skills.

As shown in FIG. 1, each pixel unit comprises a pixel main portion 101 and a pixel sub portion 102. The pixel main portion 101 has a first thin film transistor 34. The pixel sub portion 102 has a second thin film transistor 35 and a third thin film transistor 36. An output terminal of the first thin film transistor 34 is connected to a main liquid crystal capacitor of the pixel main portion 101 as well as is connected to a main storage capacitor of the pixel main portion 101. An output terminal of the second thin film transistor 35 is connected to a sub liquid crystal capacitor of the pixel sub portion 102 as well as is connected to a sub storage capacitor of the pixel sub portion 102. An input terminal of the third thin film transistor 36 is connected to the sub liquid crystal capacitor and the sub storage capacitor of the pixel sub portion. The output terminal of the third thin film transistor 36 is connected to a share capacitor 37.

The primary scan line 31 inputs a first scan signal into control terminals of the first thin film transistor 34 and the second thin film transistor 35, thereby controlling the first thin film transistor 34 and the second thin film transistor 35 to be switched on or switched off. The secondary scan line 32 inputs a second scan signal into the control terminal of the third thin film transistor 36, thereby controlling the third thin film transistor 36 to be switched on or switched off.

When a high voltage level is inputted as the first scan signal and a low voltage level is inputted as the second scan signal, the first thin film transistor 34 and the second thin film transistor 35 are switched on and the third thin film transistor 36 is switched off. Meanwhile, data signals are inputted to the input terminal of the first thin film transistor 34 and the input terminal of the second thin film transistor 35 via the data lines 33 so as to charge the pixel main portion and the pixel sub portion.

When the low voltage level is inputted as the first scan signal and the high voltage level is inputted as the second scan signal, the first thin film transistor 34 and the second thin film transistor 35 are switched off. Meanwhile, the pixel main portion and the pixel sub portion are accomplished in charging, and the third thin film transistor 36 is switched on. A part of charges of the sub liquid crystal capacitor (or the sub storage capacitor) is transferred to the share capacitor 37 via the third thin film transistor 36. That is, the charges of the sub liquid crystal capacitor and the share capacitor are redistributed such that the brightness of the pixel main portion is greater than that of the pixel sub portion.

The detection circuit of the present embodiment comprises two detection lines respectively providing scan signals for each row of the pixel units. One of the detection lines is connected to only one scan line of the pixel units and the other one of the detection lines is connected to another scan line of the pixel units.

Figure 4:
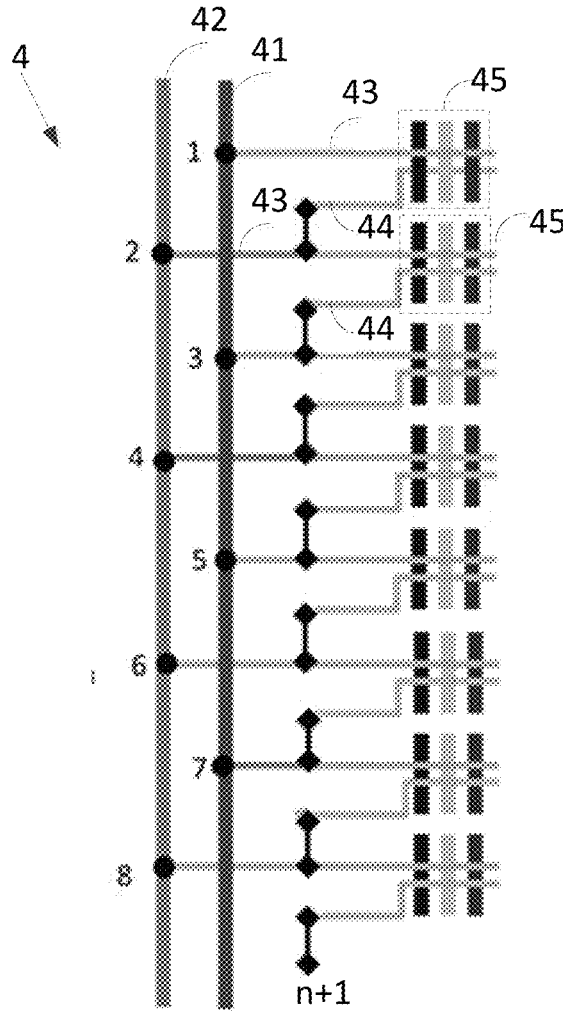
FIG. 4 is a schematic structural diagram showing a detection circuit in accordance with a first embodiment of the present invention.

Please refer to FIG. 4, which is a schematic structural diagram showing a detection circuit in accordance with a first embodiment of the present invention.

The detection circuit 4 of the present embodiment comprises two detection lines, i.e., a first detection line 41 and a second detection line 42 (the appended drawings are illustrated by only one pixel unit included in each row of the pixel units). The first detection line 41 is connected to the primary scan lines 43 of odd rows (1, 3, 5, 7) of the pixel units 45. The second detection line 42 is connected to the primary scan lines 43 of even rows (2, 4, 6, 8) of the pixel units 45. The secondary scan line of the (n)th row of the pixel units is connected to the (n+1)th primary scan line. For example, the first detection line 41 is connected to the primary scan line of the first row of the pixel units. The main detection line of the second row of the pixel units is connected to the second detection line 42. Also, the primary scan line of the second row of the pixel units is connected to the secondary scan line of the first row of the pixel units. The primary scan line of the third row of the pixel units is connected to the secondary scan line of the second row of the pixel units. Other rows of the pixel units have similar connections, where n is an integer.

Figure 5:
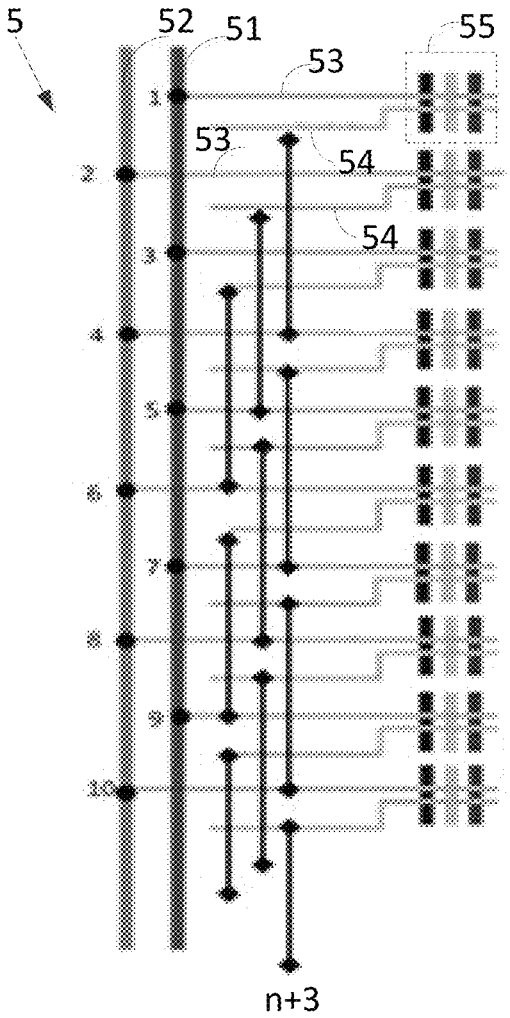
FIG. 5 is a schematic structural diagram showing a detection circuit in accordance with a second embodiment of the present invention.

FIG. 5 is a schematic structural diagram showing a detection circuit in accordance with a second embodiment of the present invention.

The detection circuit 5 of the present embodiment comprises two detection lines, i.e., a first detection line 51 and a second detection line 52 (the appended drawings are illustrated by only one pixel unit included in each row of the pixel units). The first detection line 51 is connected to the primary scan lines 53 of odd rows (1, 3, 5, 7, 9) of the pixel units 55. The second detection line 52 is connected to the primary scan lines 53 of even rows (2, 4, 6, 8, 10) of the pixel units 55. The secondary scan line of the (n)th row of the pixel units is connected to the (n+3)th primary scan line. For example, the first detection line 51 is connected to the primary scan line 53 of the first row of the pixel units 55. The main detection line 53 of the second row of the pixel units is connected to the second detection line 52. Also, the primary scan line 53 of the fourth row of the pixel units is connected to the secondary scan line of the first row of the pixel units. The primary scan line of the fifth row of the pixel units is connected to the secondary scan line of the second row of the pixel units. Other rows of the pixel units have similar connections, where n is an integer.

A method for performing detection on a display panel by using the detection circuit in accordance with the first embodiment and the second embodiment comprises the following steps.

In Step S201, a high voltage level is inputted to the first detection line and a low voltage level is inputted to the second detection line.

The first detection line is connected to the primary scan lines of odd rows of the pixel units, and the primary scan lines of even rows of the pixel units are connected to the second detection line. The primary scan line of the (n+1)th or (n+3)th of the pixel units is connected to the (n)th row of the secondary scan line. That is, the secondary scan lines of odd rows of the pixel units are connected to the primary scan lines of even rows of the pixel units. By referring FIG. 4 and FIG. 5, for example, the primary scan line of the second or the fourth row of the pixel units is connected to the secondary scan line of the first row of the pixel units. Therefore, inputting the high voltage level to the first detection line and inputting the low voltage level to the second detection line can make the first thin film transistors and the second thin film transistors of odd rows of the pixel units turn on and the third thin film transistors of odd rows of the pixel units turn off.

In Step S202, a first data signal is inputted to input terminals of the first thin film transistors and the second thin film transistors of odd rows of the pixel units by using the data lines so as to charge the pixel sub portions of odd rows of the pixel units.

When the pixel sub portions of odd rows of the pixel units are charged with electricity, the pixel main portions of odd rows of the pixel units are also charged with electricity. In this way, the charges of the main liquid crystal capacitor of an odd row of the pixel main portion are equal to that of the sub liquid crystal capacitor of said odd row of the pixel sub portion, and the charges of the main storage capacitor of an odd row of the pixel main portion are equal to that of the sub storage capacitor of said odd row of the pixel sub portion such that the voltage of an upper electrode of said odd row of the share capacitor is equal to that of the first data signal.

In Step S203, after the charging is accomplished, the low voltage level is inputted to the first detection line and the high voltage level is inputted to the second detection line.

The primary scan lines of odd rows of the pixel units are connected to the first detection line, and the primary scan lines of even rows of the pixel units are connected to the second detection line such that the primary scan lines of odd rows of the pixel units have the low voltage level and the primary scan lines of even rows of the pixel units have the high voltage level. The primary scan line of the (n+1)th or (n+3)th row of the pixel units is connected to the (n)th row of the secondary scan line (n+1 or n+3 is an even number when n is an odd number) such that the secondary scan lines of odd rows of the pixel units have the high voltage level. Therefore, inputting the high voltage level to the second detection line and inputting the low voltage level to the first detection line can make the first thin film transistors and the second thin film transistors of odd rows of the pixel units turn off, the third thin film transistors of odd rows of the pixel units turn on, and the first thin film transistors and the second thin film transistors of even rows of the pixel units turn on.

In Step S204, a second data signal is inputted to the input terminals of the first thin film transistors and the second thin film transistors of even rows of the pixel units by using the data lines.

Since the secondary scan lines of odd rows of the pixel units are connected to the primary scan lines of even rows of the pixel units, the input terminals of the third thin film transistors of odd rows of the pixel units are also inputted with the second data signal in Step S204.

The voltage of the first data signal is larger than that of the second data signal. For example, the voltage of the first data signal is a 48 gray-level voltage and the voltage of the second data signal is a zero gray-level voltage.

For odd rows of the pixel units, when the display panel is normal, the input terminals of the third thin film transistors of odd rows of the pixel units are inputted with the second data signal and the input terminals of the first thin film transistors and the second thin film transistors of odd rows of the pixel units are inputted with the first data signal such that a voltage difference is formed between the upper electrode and the lower electrode of an odd-row share capacitor. In this way, a part of the charges of the sub liquid crystal capacitor and the sub storage capacitor of an odd-row pixel sub portion can be distributed to the share capacitor, thereby making the brightness of the pixel sub portion less than that of the pixel main portion for said odd row. When the display panel is abnormal, a part of the charges of the sub liquid crystal capacitor and the sub storage capacitor of the odd-row pixel sub portion cannot be distributed to the odd-row share capacitor. Therefore, the brightness of the pixel sub portion in an abnormal state is greater than that of the pixel sub portion in a normal state for said odd row.

The brightness of the pixel sub portion is determined to be abnormal during the detection procedure if the brightness of a certain pixel sub portion in an odd row is higher than that of other pixel sub portions. Therefore, it is convenient to tackle the abnormality and maintain in time, thereby improving the quality of the display panel.

By way of above procedures, the detection on brightness abnormalities of the pixel sub portions of odd rows of the pixel units is accomplished.

Next, brightness abnormalities of the pixel sub portions of even rows of the pixel units are to be detected.

In Step S205, the high voltage level is inputted to the second detection line and the low voltage level is inputted to the first detection line.

The primary scan lines of even rows of the pixel units are connected to the second detection line, and the primary scan lines of odd rows of the pixel units are connected to the first detection line. Also, the secondary scan lines of even rows of the pixel units are connected to the primary scan lines of odd rows of the pixel units. Therefore, inputting the high voltage level to the second detection line and inputting the low voltage level to the first detection line can make the primary scan lines of even rows of the pixel units have the high voltage level and the secondary scan lines of even rows of the pixel units have the low voltage level, thereby making the first thin film transistors and the second thin film transistors of even rows of the pixel units turn on and the third thin film transistors of even rows of the pixel units turn off.

In Step S206, the first data signal is inputted to the input terminals of the first thin film transistors and the second thin film transistors of even rows of the pixel units by using the data lines so as to charge the pixel sub portions of even rows of the pixel units.

When the pixel sub portions of even rows of the pixel units are charged with electricity, the pixel main portions of even rows of the pixel units are also charged with electricity. In this way, the charges of the main liquid crystal capacitor of an even row of the pixel main portion are equal to that of the sub liquid crystal capacitor of said even row of the pixel sub portion, and the charges of the main storage capacitor of an even row of the pixel main portion are equal to that of the sub storage capacitor of said even row of the pixel sub portion such that the voltage of an upper electrode of said even row of the share capacitor is equal to that of the first data signal.

In Step S207, after the charging is accomplished, the low voltage level is inputted to the second detection line and the high voltage level is inputted to the first detection line.

The primary scan lines of odd rows of the pixel units are connected to the first detection line, and the primary scan lines of even rows of the pixel units are connected to the second detection line such that the primary scan lines of odd rows of the pixel units have the high voltage level and the primary scan lines of even rows of the pixel units have the low voltage level. The primary scan line of the (n+1)th or (n+3)th row of the pixel units is connected to the (n)th row of the secondary scan line (n+1 or n+3 is an odd number when n is an even number) such that the secondary scan lines of even rows of the pixel units have the high voltage level. Therefore, inputting the low voltage level to the second detection line and inputting the high voltage level to the first detection line can make the first thin film transistors and the second thin film transistors of even rows of the pixel units turn off, the third thin film transistors of even rows of the pixel units turn on, and the first thin film transistors and the second thin film transistors of odd rows of the pixel units turn on.

In Step S208, the second data signal is inputted to the input terminals of the first thin film transistors and the second thin film transistors of odd rows of the pixel units by using the data lines.

Since the secondary scan lines of even rows of the pixel units are connected to the primary scan lines of odd rows of the pixel units, the input terminals of the third thin film transistors of even rows of the pixel units are also inputted with the second data signal in Step S208.

The voltage of the first data signal is larger than that of the second data signal. For example, the voltage of the first data signal is a 48 gray-level voltage and the voltage of the second data signal is a zero gray-level voltage.

For even rows of the pixel units, when the display panel is normal, the input terminals of the third thin film transistors of even rows of the pixel units are inputted with the second data signal and the input terminals of the first thin film transistors and the second thin film transistors of even rows of the pixel units are inputted with the first data signal such that a voltage difference is formed between the upper electrode and the lower electrode of an even-row share capacitor. In this way, a part of the charges of the sub liquid crystal capacitor and the sub storage capacitor of an even-row pixel sub portion can be distributed to the share capacitor, thereby making the brightness of the pixel sub portion less than that of the pixel main portion for said even row. When the display panel is abnormal, a part of the charges of the sub liquid crystal capacitor and the sub storage capacitor of the even-row pixel sub portion cannot be distributed to the even-row share capacitor. Therefore, the brightness of the pixel sub portion in an abnormal state is greater than that of the pixel sub portion in a normal state for said even row.

The brightness of the pixel sub portion is determined to be abnormal during the detection procedure if the brightness of a certain pixel sub portion in an even row is higher than that of other pixel sub portions. Therefore, it is convenient to tackle the abnormality and maintain in time, thereby improving the quality of the display panel.

By way of above procedures, the detection on brightness abnormalities of the pixel sub portions of even rows of the pixel units is accomplished.

Of course, the detection on even rows of the pixel units can be prior to the detection on odd rows of the pixel units in the detection process. The first detection line can be connected to the primary scan lines of even rows of the pixel units and the second detection can be connected to the primary scan lines of odd rows of the pixel units.

By way of connecting two scan lines of a pixel unit to different detection lines and applying different voltages respectively thereto, the detection circuit of the display panel and the method for performing detection on the display panel by using said circuit in accordance with the present invention can detect abnormalities of the display panel and improve the display effect.

Figure 6:
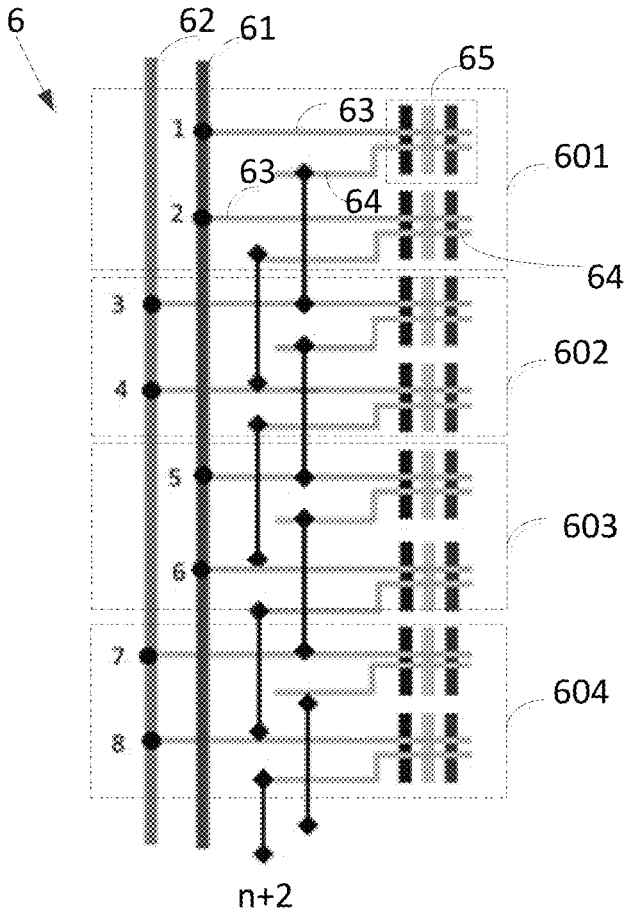
FIG. 6 is a schematic structural diagram showing a detection circuit in accordance with a third embodiment of the present invention.

Please refer to FIG. 6, which is a schematic structural diagram showing a detection circuit in accordance with a third embodiment of the present invention.

In accompanying with FIG. 6, the detection circuit 6 of the present embodiment comprises two detection lines. The two detection lines comprise a first detection line 61 and a second detection line 62. The method for performing detection on the display panel by using the detection circuit comprises the following steps.

The plural rows of pixel units are divided into four sets of detection regions (601-604). Only four sets are illustrated herein. Each set of the detection regions comprises two rows of pixel units 65. The primary scan line 63 of each row of the pixel units in the first or the third set of the detection regions 601, 603 is connected to the first detection line 61. The primary scan line 63 of each row of the pixel units in the second or the fourth set of the detection regions 602, 604 is connected to the second detection line 62. The secondary scan line 64 of the first row (No. 1) of the pixel units in the first set of the detection regions 601 is connected to the primary scan line 63 of the first row (No. 3) of the pixel units in the second set of the detection regions 602. The secondary scan line of the second row (No. 2) of the pixel units in the first set of the detection regions 601 is connected to the primary scan line of the second row (No. 4) of the pixel units in the second set of the detection regions 602. Of course, it also can connect the secondary scan line of the first row of the pixel units in the first set of the detection regions 601 to the primary scan line of the second row of the pixel units in the second set of the detection regions 602, and connect the secondary scan line of the second row of the pixel units in the first set of the detection regions 601 to the primary scan line of the first row of the pixel units in the second set of the detection regions 602.

The secondary scan line of the first row of the pixel units in the second set of the detection regions 602 is connected to the primary scan line of the first row (No. 5) of the pixel units in the third set of the detection regions 603. The secondary scan line of the second row of the pixel units in the second set of the detection regions 602 is connected to the primary scan line of the second row (No. 6) of the pixel units in the third set of the detection regions 603.

The secondary scan line of the first row of the pixel units in the third set of the detection regions 603 is connected to the primary scan line of the first row (No. 7) of the pixel units in the fourth set of the detection regions 604. The secondary scan line of the second row of the pixel units in the third set of the detection regions 603 is connected to the primary scan line of the second row (No. 8) of the pixel units in the fourth set of the detection regions 604.

When n>4, the secondary scan line of the first row of the pixel units in the (n)th set of the detection regions is connected to the primary scan line of the first row of the pixel units in the (n+1)th set of the detection regions, and the secondary scan line of the second row of the pixel units in the (n)th set of the detection regions is connected to the primary scan line of the second row of the pixel units in the (n+1)th set of the detection regions, where each set of the detection regions comprises two rows of the pixel units, and n is a positive integer.

It can be understood that the secondary scan line of one row of the pixel units in any odd set of the detection regions can be connected to the primary scan line of any one row of the pixel units in any even set of the detection regions, and the secondary scan line of one row of the pixel units in any even set of the detection regions can be connected to the primary scan line of any one row of the pixel units in the any odd set of the detection regions. For example, the secondary scan line of one row of the pixel units in the first set of the detection regions can be connected to the primary scan line of any one row of the pixel units in the second set of the detection regions, and the secondary scan line of one row of the pixel units in the first set of the detection regions can also be connected to the primary scan line of any one row of the pixel units in the fourth set of the detection regions. The secondary scan line of one row of the pixel units in the second set of the detection regions can be connected to the primary scan line of any one row of the pixel units in the third set of the detection regions, and the secondary scan line of one row of the pixel units in the second set of the detection regions can also be connected to the primary scan line of any one row of the pixel units in the first set of the detection regions.

Figure 7:
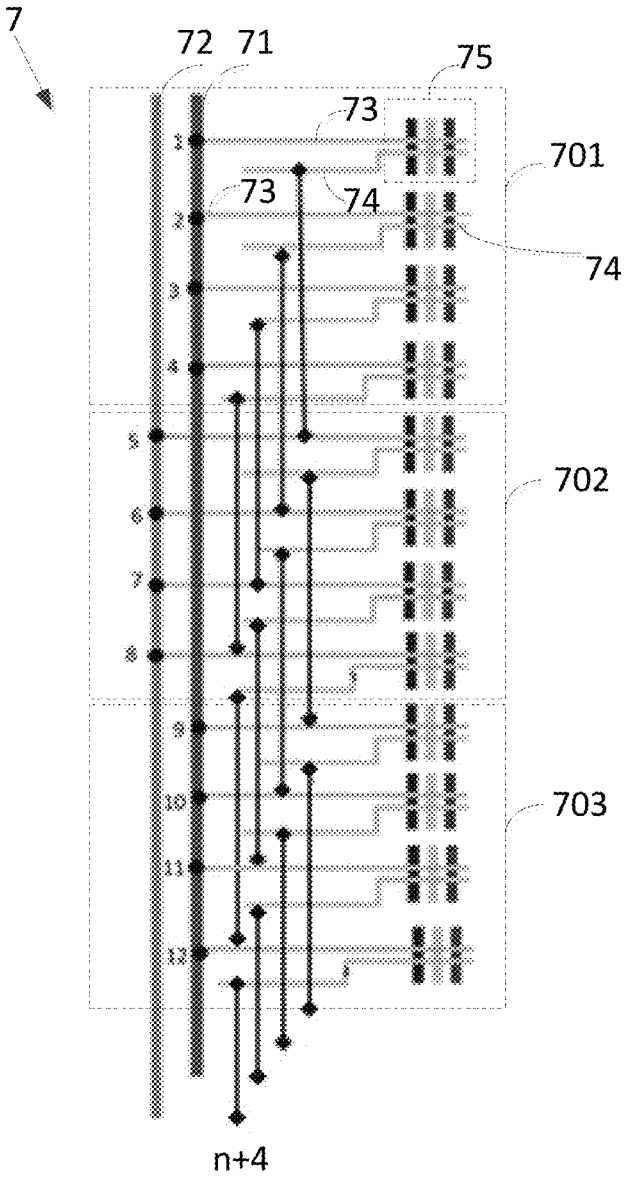
FIG. 7 is a schematic structural diagram showing a detection circuit in accordance with a fourth embodiment of the present invention.

Please refer to FIG. 7, which is a schematic structural diagram showing a detection circuit in accordance with a third embodiment of the present invention.

In accompanying with FIG. 7, the detection circuit 7 of the present embodiment comprises two detection lines. The two detection lines comprise a first detection line 71 and a second detection line 72. The method for performing detection on the display panel by using the detection circuit comprises the following steps.

The plural rows of pixel units are divided into three sets of detection regions (701-703). Only three sets are illustrated herein. Each set of the detection regions comprises four rows of pixel units 65. The primary scan line 73 of each row of the pixel units in the first or the third set of the detection regions 701, 703 is connected to the first detection line 71. The primary scan line 73 of each row of the pixel units in the second set of the detection regions 702 is connected to the second detection line 72.

The secondary scan line 73 of the first row (No. 1) of the pixel units in the first set of the detection regions 701 is connected to the primary scan line 74 of the first row (No. 5) of the pixel units in the second set of the detection regions 702. The secondary scan line of the second row (No. 2) of the pixel units in the first set of the detection regions 701 is connected to the primary scan line of the second row (No. 6) of the pixel units in the second set of the detection regions

702. The secondary scan line of the third row (No. 3) of the pixel units in the first set of the detection regions 701 is connected to the primary scan line of the third row (No. 7) of the pixel units in the second set of the detection regions 702. The secondary scan line of the fourth row (No. 4) of the pixel units in the first set of the detection regions 701 is connected to the primary scan line of the fourth row (No. 8) of the pixel units in the second set of the detection regions 702.

The secondary scan line 73 of the first row of the pixel units in the second set of the detection regions 702 is connected to the primary scan line 74 of the first row (No. 9) of the pixel units in the third set of the detection regions 703. The secondary scan line 73 of the second row of the pixel units in the second set of the detection regions 702 is connected to the primary scan line 74 of the second row (No. 10) of the pixel units in the third set of the detection regions 703. The secondary scan line 73 of the third row of the pixel units in the second set of the detection regions 702 is connected to the primary scan line 74 of the third row (No. 11) of the pixel units in the third set of the detection regions 703. The secondary scan line 73 of the fourth row of the pixel units in the second set of the detection regions 702 is connected to the primary scan line 74 of the fourth row (No. 12) of the pixel units in the third set of the detection regions 703.

When n>3, the secondary scan line of the first row of the pixel units in the (n)th set of the detection regions is connected to the primary scan line of the first row of the pixel units in the (n+1)th set of the detection regions, the secondary scan line of the second row of the pixel units in the (n)th set of the detection regions is connected to the primary scan line of the second row of the pixel units in the (n+1)th set of the detection regions, the secondary scan line of the third row of the pixel units in the (n)th set of the detection regions is connected to the primary scan line of the third row of the pixel units in the (n+1)th set of the detection regions, and the secondary scan line of the fourth row of the pixel units in the (n)th set of the detection regions is connected to the primary scan line of the fourth row of the pixel units in the (n+1)th set of the detection regions, where each set of the detection regions comprises four rows of the pixel units, and n is a positive integer. It can also connect the secondary scan line of the first row of the pixel units in the (n)th set of the detection regions to the primary scan line of any of the second, third, and fourth rows of the pixel units in the (n+1)th set of the detection regions. The connection variations for other rows are not repeated herein.

It can be understood that each set of the detection regions comprises h rows of the pixel units, where h may be larger than 4 (e.g., six rows); alternatively, h=2k, k≥1, that is, h is an even number.

Of course, it can be understood that the secondary scan line of one row of the pixel units in any odd set of the detection regions can be connected to the primary scan line of any one row of the pixel units in any even set of the detection regions, and the secondary scan line of one row of the pixel units in any even set of the detection regions can be connected to the primary scan line of any one row of the pixel units in the any odd set of the detection regions. For example, the secondary scan line of one row of the pixel units in the first set of the detection regions can be connected to the primary scan line of any one row of the pixel units in the second set of the detection regions, and the secondary scan line of one row of the pixel units in the first set of the detection regions can also be connected to the primary scan line of any one row of the pixel units in the fourth set of the detection regions. The secondary scan line of one row of the pixel units in the second set of the detection regions can be connected to the primary scan line of any one row of the pixel units in the third set of the detection regions, and the secondary scan line of one row of the pixel units in the second set of the detection regions can also be connected to the primary scan line of any one row of the pixel units in the first set of the detection regions. The method for performing detection on the display panel for the two types of detection circuits comprises the following steps.

In Step S301, a high voltage level is inputted to the first detection line and a low voltage level is inputted to the second detection line.

The primary scan line of each row of the pixel units in the (2n+1)th set of the detection regions is connected to the first detection line, and the primary scan line of each row of the pixel units in the (2n)th set of the detection regions is connected to the second detection line such that the primary scan line of each row of the pixel units in the (2n+1)th set of the detection regions has the low voltage level. The secondary scan line of each row of the pixel units in the (n)th set of the detection regions is connected to the primary scan line of any row of the pixel units in the (n+1)th set of the detection regions such that the secondary scan line of each row of the pixel units in the (2n+1)th set of the detection regions has the low voltage level. Therefore, inputting the high voltage level to the first detection line and inputting the low voltage level to the second detection line can make the first thin film transistor and the second thin film transistor of each row of the pixel units in the (2n+1)th (odd) set of the detection regions (e.g., 601, 603) turn on, the third thin film transistor of each row of the pixel units in the (2n+1)th set of the detection regions turn off.

In Step S302, a first data signal is inputted to input terminals of the first thin film transistor and the second thin film transistor of each row of the pixel units in the (2n+1)th set of the detection regions by using the data lines so as to charge the pixel sub portion of each row of the pixel units in the (2n+1)th set of the detection regions.

When the pixel sub portions of all the pixel units in odd sets of the detection regions are charged with electricity, the pixel main portions of all the pixel units in odd sets of the detection regions are also charged with electricity. In this way, the charges of the main liquid crystal capacitors of the pixel main portions of all the pixel units in odd sets of the detection regions are equal to that of the sub liquid crystal capacitors of the pixel sub portions of all the pixel units in odd sets of the detection regions, and the charges of the main storage capacitors of the pixel main portions are equal to that of the sub storage capacitors of the pixel sub portions such that the voltage of an upper electrode of the share capacitors of all the pixel units in odd sets of the detection regions is equal to that of the first data signal.

In Step S303, after the charging is accomplished, the low voltage level is inputted to the first detection line and the high voltage level is inputted to the second detection line.

The primary scan line of each row of the pixel units in the (2n+1)th set of the detection regions is connected to the first detection line, and the primary scan line of each row of the pixel units in the (2n)th set of the detection regions is connected to the second detection line such that the primary scan line of each row of the pixel units in the (2n+1)th (odd) set of the detection regions has the low voltage level and the primary scan line of each row of the pixel units in the (2n)th (even) set of the detection regions have the high voltage level. The secondary scan line of each row of the pixel units in the (n)th set of the detection regions is connected to the secondary scan line of any row of the pixel units in the (n+1)th set of the detection regions (n+1 is an even number when n is an odd number) such that the secondary scan line of each row of the pixel units in the (2n+1)th (odd) set of the detection regions have the high voltage level. In such a manner, the first thin film transistor and the second thin film transistor of each row of the pixel units in the (2n+1)th set of the detection regions are turned off, the third thin film transistor of each row of the pixel units in the (2n+1)th set of the detection regions is turned on, and the first thin film transistor and the second thin film transistor of each row of the pixel units in the (2n)th set of the detection regions are turned on.

In Step S304, a second data signal is inputted to the input terminals of the first thin film transistor and the second thin film transistor of each row of the pixel units in the (2n)th set of the detection regions by using the data lines so as to check whether or not the brightness of the pixel sub portion of each row of the pixel units in the (2n+1)th set of the detection regions is abnormal and produce a detection result.

Since the secondary scan line of each row of the pixel units in the (2n+1)th set of the detection regions is connected to the primary scan line of each row of the pixel units in the (2n)th set of the detection regions, the input terminal of the third thin film transistor of each row of the pixel units in the (2n+1)th set of the detection regions is also inputted with the second data signal in Step S304.

The voltage of the first data signal is larger than that of the second data signal. For example, the voltage of the first data signal is a 48 gray-level voltage and the voltage of the second data signal is a zero gray-level voltage.

When the display panel is normal, the input terminals of the first thin film transistor and the second thin film transistor of each row of the pixel units in the (2n+1)th set of the detection regions are inputted with the first data signal and the input terminal of the third thin film transistor of each row of the pixel units in the (2n+1)th set of the detection regions is inputted with the second data signal such that a voltage difference is formed between the upper electrode and the lower electrode of the share capacitors of all the pixel units in odd sets of the detection regions. In this way, a part of the charges of the sub liquid crystal capacitors and the sub storage capacitors of the pixel sub portions of all the pixel units in odd sets of the detection regions can be distributed to the share capacitors, thereby making the brightness of the pixel sub portions of all the pixel units in odd sets of the detection regions less than that of the pixel main portions. When the display panel is abnormal, a part of the charges of the sub liquid crystal capacitors and the sub storage capacitors of the pixel sub portions of all the pixel units in odd sets of the detection regions cannot be distributed to the share capacitors. Therefore, the brightness of the pixel sub portions in an abnormal state is greater than that of the pixel sub portions in a normal state for all the pixel units in odd sets of the detection regions.

During determining whether or not the display panel is abnormal, the brightness of a pixel sub portion in odd sets of the detection regions is compared to a predetermined brightness threshold and a detection result is accordingly produced, where the predetermined brightness threshold is an average of the brightness of the pixel sub portions of all the pixel units on the display panel. The brightness of a certain pixel sub portion is determined to be abnormal if the brightness of said pixel sub portion of the pixel unit is higher than the predetermined brightness threshold. This indicates that the display panel is abnormal. Therefore, it is convenient to tackle the abnormality and maintain in time, thereby improving the quality of the display panel.

By way of above procedures, the detection on brightness abnormalities of the pixel sub portions of odd sets of the detection regions is accomplished.

Next, brightness abnormalities of the pixel sub portions of even sets of the detection regions are to be detected.

In Step S305, the high voltage level is inputted to the second detection line and the low voltage level is inputted to the first detection line.

The primary scan line of each row of the pixel units in the (2n+1)th set of the detection regions is connected to the first detection line, and the primary scan line of each row of the pixel units in the (2n)th set of the detection regions is connected to the second detection line such that the primary scan line of each row of the pixel units in the (2n)th set of the detection regions has the high voltage level. The secondary scan line of each row of the pixel units in the (n)th set of the detection regions is connected to the primary scan line of any row of the pixel units in the (n+1)th set of the detection regions such that the secondary scan line of each row of the pixel units in the (2n)th set of the detection regions has the low voltage level. Therefore, inputting the high voltage level to the first detection line and inputting the low voltage level to the second detection line can make the first thin film transistor and the second thin film transistor of each row of the pixel units in the (2n)th set of the detection regions turn on, the third thin film transistor of each row of the pixel units in the (2n)th set of the detection regions turn off.

In Step S306, the first data signal is inputted to the input terminals of the first thin film transistor and the second thin film transistor of each row of the pixel units in the (2n)th set of the detection regions by using the data lines so as to charge the pixel sub portion of each row of the pixel units in the (2n)th set of the detection regions.

When the pixel sub portions of all the pixel units in even sets of the detection regions are charged with electricity, the pixel main portions of all the pixel units in even sets of the detection regions are also charged with electricity. In this way, the charges of the main liquid crystal capacitors of the pixel main portions of all the pixel units in even sets of the detection regions are equal to that of the sub liquid crystal capacitors of the pixel sub portions of all the pixel units in even sets of the detection regions, and the charges of the main storage capacitors of the pixel main portions are equal to that of the sub storage capacitors of the pixel sub portions such that the voltage of an upper electrode of the share capacitors of all the pixel units in even sets of the detection regions is equal to that of the first data signal.

In Step S307, after the charging is accomplished, the low voltage level is inputted to the second detection line and the high voltage level is inputted to the first detection line.

The primary scan line of each row of the pixel units in the (2n+1)th set of the detection regions is connected to the first detection line, and the primary scan line of each row of the pixel units in the (2n)th set of the detection regions is connected to the second detection line such that the primary scan line of each row of the pixel units in the (2n)th (even) set of the detection regions has the low voltage level and the primary scan line of each row of the pixel units in the (2n+1)th (odd) set of the detection regions have the high voltage level. The secondary scan line of each row of the pixel units in the (n)th set of the detection regions is connected to the secondary scan line of any row of the pixel units in the (n+1)th set of the detection regions (n+1 is an odd number when n is an even number) such that the secondary scan line of each row of the pixel units in the (2n)th (even) set of the detection regions have the high voltage level. In such a manner, the first thin film transistor and the second thin film transistor of each row of the pixel units in the (2n)th set of the detection regions are turned off, the third thin film transistor of each row of the pixel units in the (2n)th set of the detection regions is turned on, and the first thin film transistor and the second thin film transistor of each row of the pixel units in the (2n+1)th set of the detection regions are turned on.

In Step S308, the second data signal is inputted to the input terminals of the first thin film transistor and the second thin film transistor of each row of the pixel units in the (2n+1)th set of the detection regions by using the data lines so as to check whether or not the brightness of the pixel sub portion of each row of the pixel units in the (2n)th set of the detection regions is abnormal and produce a detection result.

Since the secondary scan line of each row of the pixel units in the (2n)th set of the detection regions is connected to the primary scan line of each row of the pixel units in the (2n+1)th set of the detection regions, the input terminal of the third thin film transistor of each row of the pixel units in the (2n)th set of the detection regions is also inputted with the second data signal in Step S308.

When the display panel is normal, the input terminals of the first thin film transistor and the second thin film transistor of each row of the pixel units in the (2n)th set of the detection regions are inputted with the first data signal and the input terminal of the third thin film transistor of each row of the pixel units in the (2n)th set of the detection regions is inputted with the second data signal such that a voltage difference is formed between the upper electrode and the lower electrode of the share capacitors of all the pixel units in even sets of the detection regions. In this way, a part of the charges of the sub liquid crystal capacitors and the sub storage capacitors of the pixel sub portions of all the pixel units in even sets of the detection regions can be distributed to the share capacitors, thereby making the brightness of the pixel sub portions of all the pixel units in even sets of the detection regions less than that of the pixel main portions. When the display panel is abnormal, a part of the charges of the sub liquid crystal capacitors and the sub storage capacitors of the pixel sub portions of all the pixel units in even sets of the detection regions cannot be distributed to the share capacitors. Therefore, the brightness of the pixel sub portions in an abnormal state is greater than that of the pixel sub portions in a normal state for all the pixel units in even sets of the detection regions.

During determining whether or not the display panel is abnormal, the brightness of a pixel sub portion in even sets of the detection regions is compared to a predetermined brightness threshold and a detection result is accordingly produced, where the predetermined brightness threshold is an average of the brightness of the pixel sub portions of all the pixel units on the display panel. The brightness of a certain pixel sub portion is determined to be abnormal if the brightness of said pixel sub portion of the pixel unit is higher than the predetermined brightness threshold. This indicates that the display panel is abnormal. Therefore, it is convenient to tackle the abnormality and maintain in time, thereby improving the quality of the display panel.

Of course, the detection on even sets of the detection regions can be prior to the detection on odd sets of the detection regions.

Similarly, as another implementation of the present invention, the plural rows of pixel units are divided into n sets of detection regions. Each set of the detection regions comprises h rows of pixel units. The primary scan line of each row of the pixel units in the (2n+1)th set of the detection regions is connected to the second detection line. The primary scan line of each row of the pixel units in the (2n)th set of the detection regions is connected to the first detection line. The secondary scan line of each row of the pixel units in the (n)th set of the detection regions is connected to the primary scan line of any row of the pixel units in the (n+1)th set of the detection regions, where n is a positive integer, $h=2k$, $k\geq 1$.

The method for performing detection on the display panel for this detection circuit comprises the following steps.

In Step S401, a high voltage level is inputted to the second detection line and a low voltage level is inputted to the first detection line.

The primary scan line of each row of the pixel units in the (2n+1)th set of the detection regions is connected to the second detection line, and the primary scan line of each row of the pixel units in the (2n)th set of the detection regions is connected to the first detection line such that the primary scan line of each row of the pixel units in the (2n+1)th set of the detection regions has the high voltage level. The secondary scan line of each row of the pixel units in the (n)th set of the detection regions is connected to the primary scan line of any row of the pixel units in the (n+1)th set of the detection regions such that the secondary scan line of each row of the pixel units in the (2n+1)th set of the detection regions has the low voltage level. Therefore, inputting the high voltage level to the second detection line and inputting the low voltage level to the first detection line can make the first thin film transistor and the second thin film transistor of each row of the pixel units in the (2n+1)th set of the detection regions turn on, the third thin film transistor of each row of the pixel units in the (2n+1)th set of the detection regions turn off.

In Step S402, a first data signal is inputted to input terminals of the first thin film transistor and the second thin film transistor of each row of the pixel units in the (2n+1)th set of the detection regions by using the data lines so as to charge the pixel sub portion of each row of the pixel units in the (2n+1)th set of the detection regions.

When the pixel sub portions of all the pixel units in odd sets of the detection regions are charged with electricity, the pixel main portions of all the pixel units in odd sets of the detection regions are also charged with electricity. In this way, the charges of the main liquid crystal capacitors of the pixel main portions of all the pixel units in odd sets of the detection regions are equal to that of the sub liquid crystal capacitors of the pixel sub portions of all the pixel units in odd sets of the detection regions, and the charges of the main storage capacitors of the pixel main portions are equal to that of the sub storage capacitors of the pixel sub portions such that the voltage of an upper electrode of the share capacitors of all the pixel units in odd sets of the detection regions is equal to that of the first data signal.

In Step S403, after the charging is accomplished, the low voltage level is inputted to the second detection line and the high voltage level is inputted to the first detection line.

The primary scan line of each row of the pixel units in the (2n+1)th set of the detection regions is connected to the second detection line, and the primary scan line of each row of the pixel units in the (2n)th set of the detection regions is connected to the first detection line such that the primary scan line of each row of the pixel units in the (2n+1)th (odd) set of the detection regions has the low voltage level and the primary scan line of each row of the pixel units in the (2n)th (even) set of the detection regions have the high voltage level. The secondary scan line of each row of the pixel units in the (n)th set of the detection regions is connected to the secondary scan line of any row of the pixel units in the (n+1)th set of the detection regions (n+1 is an even number when n is an odd number) such that the secondary scan line of each row of the pixel units in the (2n+1)th (odd) set of the detection regions have the high voltage level. In such a manner, the first thin film transistor and the second thin film transistor of each row of the pixel units in the (2n+1)th set of the detection regions are turned off, the third thin film transistor of each row of the pixel units in the (2n+1)th set of the detection regions is turned on, and the first thin film transistor and the second thin film transistor of each row of the pixel units in the (2n)th set of the detection regions are turned on.

In Step S404, a second data signal is inputted to the input terminals of the first thin film transistor and the second thin film transistor of each row of the pixel units in the (2n)th set of the detection regions by using the data lines so as to check whether or not the brightness of the pixel sub portion of each row of the pixel units in the (2n+1)th set of the detection regions is abnormal and produce a detection result.

Since the secondary scan line of each row of the pixel units in the (2n+1)th set of the detection regions is connected to the primary scan line of each row of the pixel units in the (2n)th set of the detection regions, the input terminal of the third thin film transistor of each row of the pixel units in the (2n+1)th set of the detection regions is also inputted with the second data signal in Step S304.

The voltage of the first data signal is larger than that of the second data signal. For example, the voltage of the first data signal is a 48 gray-level voltage and the voltage of the second data signal is a zero gray-level voltage.

When the display panel is normal, the input terminals of the first thin film transistor and the second thin film transistor of each row of the pixel units in the (2n+1)th set of the detection regions are inputted with the first data signal and the input terminal of the third thin film transistor of each row of the pixel units in the (2n+1)th set of the detection regions is inputted with the second data signal such that a voltage difference is formed between the upper electrode and the lower electrode of the share capacitors of all the pixel units in odd sets of the detection regions. In this way, a part of the charges of the sub liquid crystal capacitors and the sub storage capacitors of the pixel sub portions of all the pixel units in odd sets of the detection regions can be distributed to the share capacitors, thereby making the brightness of the pixel sub portions of all the pixel units in odd sets of the detection regions less than that of the pixel main portions. When the display panel is abnormal, a part of the charges of the sub liquid crystal capacitors and the sub storage capacitors of the pixel sub portions of all the pixel units in odd sets of the detection regions cannot be distributed to the share capacitors. Therefore, the brightness of the pixel sub portions in an abnormal state is greater than that of the pixel sub portions in a normal state for all the pixel units in odd sets of the detection regions.

During determining whether or not the display panel is abnormal, the brightness of a pixel sub portion in odd sets of the detection regions is compared to a predetermined brightness threshold and a detection result is accordingly produced, where the predetermined brightness threshold is an average of the brightness of the pixel sub portions of all the pixel units on the display panel. The brightness of a certain pixel sub portion is determined to be abnormal if the brightness of said pixel sub portion of the pixel unit is higher than the predetermined brightness threshold. This indicates that the display panel is abnormal. Therefore, it is convenient to tackle the abnormality and maintain in time, thereby improving the quality of the display panel.

By way of above procedures, the detection on brightness abnormalities of the pixel sub portions of odd sets of the detection regions is accomplished.

Next, brightness abnormalities of the pixel sub portions of even sets of the detection regions are to be detected.

In Step S405, the high voltage level is inputted to the first detection line and the low voltage level is inputted to the second detection line.

The primary scan line of each row of the pixel units in the (2n+1)th set of the detection regions is connected to the second detection line, and the primary scan line of each row of the pixel units in the (2n)th set of the detection regions is connected to the first detection line such that the primary scan line of each row of the pixel units in the (2n)th set of the detection regions has the high voltage level. The secondary scan line of each row of the pixel units in the (n)th set of the detection regions is connected to the primary scan line of any row of the pixel units in the (n+1)th set of the detection regions such that the secondary scan line of each row of the pixel units in the (2n)th set of the detection regions has the low voltage level. Therefore, inputting the high voltage level to the first detection line and inputting the low voltage level to the second detection line can make the first thin film transistor and the second thin film transistor of each row of the pixel units in the (2n)th set of the detection regions turn on, the third thin film transistor of each row of the pixel units in the (2n)th set of the detection regions turn off.

In Step S406, the first data signal is inputted to the input terminals of the first thin film transistor and the second thin film transistor of each row of the pixel units in the (2n)th set of the detection regions by using the data lines so as to charge the pixel sub portion of each row of the pixel units in the (2n)th set of the detection regions.

When the pixel sub portions of all the pixel units in even sets of the detection regions are charged with electricity, the pixel main portions of all the pixel units in even sets of the detection regions are also charged with electricity. In this way, the charges of the main liquid crystal capacitors of the pixel main portions of all the pixel units in even sets of the detection regions are equal to that of the sub liquid crystal capacitors of the pixel sub portions of all the pixel units in even sets of the detection regions, and the charges of the main storage capacitors of the pixel main portions are equal to that of the sub storage capacitors of the pixel sub portions such that the voltage of an upper electrode of the share capacitors of all the pixel units in even sets of the detection regions is equal to that of the first data signal.

In Step S407, after the charging is accomplished, the low voltage level is inputted to the first detection line and the high voltage level is inputted to the second detection line.

The primary scan line of each row of the pixel units in the (2n+1)th set of the detection regions is connected to the second detection line, and the primary scan line of each row of the pixel units in the (2n)th set of the detection regions is connected to the first detection line such that the primary scan line of each row of the pixel units in the (2n)th (even) set of the detection regions has the low voltage level and the primary scan line of each row of the pixel units in the (2n+1)th (odd) set of the detection regions have the high voltage level. The secondary scan line of each row of the pixel units in the (n)th set of the detection regions is connected to the secondary scan line of any row of the pixel units in the (n+1)th set of the detection regions (n+1 is an odd number when n is an even number) such that the secondary scan line of each row of the pixel units in the (2n)th (even) set of the detection regions have the high voltage level. In such a manner, the first thin film transistor and the second thin film transistor of each row of the pixel units in the (2n)th set of the detection regions are turned off, the third thin film transistor of each row of the pixel units in the (2n)th set of the detection regions is turned on, and the first thin film transistor and the second thin film transistor of each row of the pixel units in the (2n+1)th set of the detection regions are turned on.

In Step S408, the second data signal is inputted to the input terminals of the first thin film transistor and the second thin film transistor of each row of the pixel units in the (2n+1)th set of the detection regions by using the data lines so as to check whether or not the brightness of the pixel sub portion of each row of the pixel units in the (2n)th set of the detection regions is abnormal and produce a detection result, wherein the voltage of the first data signal is larger than that of the second data signal.

Since the secondary scan line of each row of the pixel units in the (2n)th set of the detection regions is connected to the primary scan line of each row of the pixel units in the (2n+1)th set of the detection regions, the input terminal of the third thin film transistor of each row of the pixel units in the (2n)th set of the detection regions is also inputted with the second data signal in Step S408.

When the display panel is normal, the input terminals of the first thin film transistor and the second thin film transistor of each row of the pixel units in the (2n)th set of the detection regions are inputted with the first data signal and the input terminal of the third thin film transistor of each row of the pixel units in the (2n)th set of the detection regions is inputted with the second data signal such that a voltage difference is formed between the upper electrode and the lower electrode of the share capacitors of all the pixel units in even sets of the detection regions. In this way, a part of the charges of the sub liquid crystal capacitors and the sub storage capacitors of the pixel sub portions of all the pixel units in even sets of the detection regions can be distributed to the share capacitors, thereby making the brightness of the pixel sub portions of all the pixel units in even sets of the detection regions less than that of the pixel main portions. When the display panel is abnormal, a part of the charges of the sub liquid crystal capacitors and the sub storage capacitors of the pixel sub portions of all the pixel units in even sets of the detection regions cannot be distributed to the share capacitors. Therefore, the brightness of the pixel sub portions in an abnormal state is greater than that of the pixel sub portions in a normal state for all the pixel units in even sets of the detection regions.

During determining whether or not the display panel is abnormal, the brightness of a pixel sub portion in even sets of the detection regions is compared to a predetermined brightness threshold and a detection result is accordingly produced, where the predetermined brightness threshold is an average of the brightness of the pixel sub portions of all the pixel units on the display panel. The brightness of a certain pixel sub portion is determined to be abnormal if the brightness of said pixel sub portion of the pixel unit is higher than the predetermined brightness threshold. This indicates that the display panel is abnormal. Therefore, it is convenient to tackle the abnormality and maintain in time, thereby improving the quality of the display panel.

By way of dividing the plural pixel units into a plurality of sets of detection regions, connecting the primary scan lines in odd and even sets of the detection regions to different detection lines, connecting the primary scan lines of the even sets to the secondary scan lines of the odd sets, connecting the primary scan lines of the odd sets to the secondary scan lines of the even sets, and applying different voltages respectively thereto, the method for performing detection on the display panel by using said circuit in accordance with the present invention can detect abnormalities of the display panel and improve the display effect.

While the preferred embodiments of the present invention have been illustrated and described in detail, various modifications and alterations can be made by persons skilled in this art. The embodiment of the present invention is therefore described in an illustrative but not restrictive sense. It is intended that the present invention should not be limited to the particular forms as illustrated, and that all modifications and alterations which maintain the spirit and realm of the present invention are within the scope as defined in the appended claims.

What is claimed is:

1. A method for performing detection on a display panel by using a detection circuit, which comprises an array substrate, said array substrate comprising: data lines, scan lines, a plurality of pixel units defined by the data lines and the scan lines, the plural pixel units forming a plurality of rows of pixel units, a scan line corresponding to the pixel units comprising a primary scan line and a secondary scan line; each pixel unit comprises a pixel main portion and a pixel sub portion, the pixel main portion has a first thin film transistor, the pixel sub portion has a second thin film transistor and a third thin film transistor, the primary scan line is used to input a first scan signal into control terminals of the first thin film transistor and the second thin film transistor, the first scan signal is used to control input of data signals to input terminals of the first thin film transistor and the second thin film transistor, an output terminal of the first thin film transistor is connected to a main liquid crystal capacitor of the pixel main portion, an output terminal of the second thin film transistor is connected to a sub liquid crystal capacitor of the pixel sub portion; and the secondary scan line is used to input a second scan signal into the control terminal of the third thin film transistor when the first thin film transistor is disconnected from the second thin film transistor, the second scan signal is used to redistribute charges of the sub liquid crystal capacitor and a share capacitor, the input terminal of the third thin film transistor is connected to the sub liquid crystal capacitor of the pixel sub portion, the output terminal of the third thin film transistor is connected to the share capacitor; the detection circuit comprising two detection lines respectively providing scan signals for each row of the pixel units; the two detection lines comprise a first detection line and a second detection line, characterized in that said method comprises:

dividing the plural rows of pixel units into n sets of detection regions, each set of the detection regions comprising h rows of pixel units, the primary scan line of each row of the pixel units in a (2s+1)th set of the detection regions being connected to the first detection line, the primary scan line of each row of the pixel units in a (2s+2)th set of the detection regions being connected to the second detection line, the secondary scan line of each row of the pixel units in a (t)th set of the detection regions being connected to the primary scan line of any row of the pixel units in a (t+1)th set of the detection regions, where n is a positive integer greater than or equal to 2, h=2k, and s is an integer greater than or equal to 0, and k and t are an integer greater than or equal to 1;

inputting a high voltage level to the first detection line and inputting a low voltage level to the second detection line such that the first thin film transistor and the second thin film transistor of each row of the pixel units in the (2s+1)th set of the detection regions are turned on and the third thin film transistor of each row of the pixel units in the (2s+1)th set of the detection regions is turned off;

inputting a first data signal to each row of the pixel units in the (2s+1)th set of the detection regions by using the data lines so as to charge the pixel sub portion of each row of the pixel units in the (2s+1)th set of the detection regions;

after the step of inputting the first data signal to each row of the pixel units in the (2s+1)th set of the detection regions by using the data lines, said method further comprising:

inputting the low voltage level to the first detection line and inputting the high voltage level to the second detection line such that the first thin film transistor and the second thin film transistor of each row of the pixel units in the (2s+1)th set of the detection regions are turned off and the third thin film transistor of each row of the pixel units in the (2s+1)th set of the detection regions is turned on;

inputting a second data signal to each row of the pixel units in the (2s+2)th set of the detection regions by using the data lines so as to check whether or not the brightness of the pixel sub portion of each row of the pixel units in the (2s+1)th set of the detection regions is abnormal and produce a detection result;

inputting the high voltage level to the second detection line and inputting the low voltage level to the first detection line such that the first thin film transistor and the second thin film transistor of each row of the pixel units in the (2s+2)th set of the detection regions are turned on and the third thin film transistor of each row of the pixel units in the (2s+2)th set of the detection regions is turned off;

inputting the first data signal to each row of the pixel units in the (2s+2)th set of the detection regions by using the data lines so as to charge the pixel sub portion of each row of the pixel units in the (2s+2)th set of the detection regions;

after the step of inputting the first data signal to each row of the pixel units in the (2s+2)th set of the detection regions by using the data lines, said method further comprising:

inputting the low voltage level to the second detection line and inputting the high voltage level to the first detection line such that the first thin film transistor and the second thin film transistor of each row of the pixel units in the (2s+2)th set of the detection regions are turned off and the third thin film transistor of each row of the pixel units in the (2s+2)th set of the detection regions is turned on;

inputting the second data signal to each row of the pixel units in the (2s+1)th set of the detection regions by using the data lines so as to check whether or not the brightness of the pixel sub portion of each row of the pixel units in the (2s+2)th set of the detection regions is abnormal and produce a detection result;

wherein the voltage of the first data signal is larger than that of the second data signal.

2. The method according to claim 1, wherein the brightness of the pixel sub portion is compared with a predetermined brightness threshold to produce the detection result.

3. The method according to claim 2, wherein the brightness of the pixel sub portion is abnormal when the detection result indicates that the brightness of the pixel sub portion is greater than the predetermined brightness threshold.

4. The method according to claim 2, wherein the brightness of the pixel sub portion is normal when the detection result indicates that the brightness of the pixel sub portion is less than or equal to the predetermined brightness threshold.

5. A method for performing detection on a display panel by using a detection circuit, which comprises an array substrate, said array substrate comprising: data lines, scan lines, a plurality of pixel units defined by the data lines and the scan lines, the plural pixel units forming a plurality of rows of pixel units, a scan line corresponding to the pixel units comprising a primary scan line and a secondary scan line; each pixel unit comprises a pixel main portion and a pixel sub portion, the pixel main portion has a first thin film transistor, the pixel sub portion has a second thin film transistor and a third thin film transistor, the primary scan line is used to input a first scan signal into control terminals of the first thin film transistor and the second thin film transistor, the first scan signal is used to control input of data signals to input terminals of the first thin film transistor and the second thin film transistor, an output terminal of the first thin film transistor is connected to a main liquid crystal capacitor of the pixel main portion, an output terminal of the second thin film transistor is connected to a sub liquid crystal capacitor of the pixel sub portion; and the secondary scan line is used to input a second scan signal into the control terminal of the third thin film transistor when the first thin film transistor is disconnected from the second thin film transistor, the second scan signal is used to redistribute charges of the sub liquid crystal capacitor and a share capacitor, the input terminal of the third thin film transistor is connected to the sub liquid crystal capacitor of the pixel sub portion, the output terminal of the third thin film transistor is connected to the share capacitor; the detection circuit comprising two detection lines respectively providing scan signals for each row of the pixel units; the two detection lines comprise a first detection line and a second detection line, characterized in that said method comprises dividing the plural rows of pixel units into n sets of detection regions, each set of the detection regions comprising h rows of pixel units, the primary scan line of each row of the pixel units in a (2s+1)th set of the detection regions being connected to the second detection line, the primary scan line of each row of the pixel units in a (2s+2)th set of the detection regions being connected to the first detection line, the secondary scan line of each row of the pixel units in a (t)th set of the detection regions being connected to the primary scan line of any row of the pixel units in a (t+1)th set of the detection regions, where n is a positive integer greater than or equal to 2, h=2k, and s is an integer greater than or equal to 0, and k and t are an integer greater than or equal to 1.

6. The method according to claim 5, further comprising:

inputting a high voltage level to the second detection line and inputting a low voltage level to the first detection line such that the first thin film transistor and the second thin film transistor of each row of the pixel units in the (2s+1)th set of the detection regions are turned on and the third thin film transistor of each row of the pixel units in the (2s+1)th set of the detection regions is turned off;

inputting a first data signal to each row of the pixel units in the (2s+1)th set of the detection regions by using the data lines so as to charge the pixel sub portion of each row of the pixel units in the (2s+1)th set of the detection regions;

after the step of inputting the first data signal to each row of the pixel units in the (2s+1)th set of the detection regions by using the data lines, said method further comprising:

inputting the low voltage level to the second detection line and inputting the high voltage level to the first detection line such that the first thin film transistor and the second thin film transistor of each row of the pixel units in the (2s+1)th set of the detection regions are turned off and the third thin film transistor of each row of the pixel units in the (2s+1)th set of the detection regions is turned on; and inputting a second data signal to each row of the pixel units in the (2s+2)th set of the detection regions by using the data lines so as to check whether or not the brightness of the pixel sub portion of each row of the pixel units in the (2s+1)th set of the detection regions is abnormal and produce a detection result;

wherein the voltage of the first data signal is larger than that of the second data signal.

7. The method according to claim 6, wherein the brightness of the pixel sub portion is compared with a predetermined brightness threshold to produce the detection result.

8. The method according to claim 7, wherein the brightness of the pixel sub portion is abnormal when the detection result indicates that the brightness of the pixel sub portion is greater than the predetermined brightness threshold.

9. The method according to claim 7, wherein the brightness of the pixel sub portion is normal when the detection result indicates that the brightness of the pixel sub portion is less than or equal to the predetermined brightness threshold.

10. The method according to claim 5, further comprising:

inputting a high voltage level to the first detection line and inputting a low voltage level to the second detection line such that the first thin film transistor and the second thin film transistor of each row of the pixel units in the (2s+2)th set of the detection regions are turned on and the third thin film transistor of each row of the pixel units in the (2s+2)th set of the detection regions is turned off;

inputting a first data signal to each row of the pixel units in the (2s+2)th set of the detection regions by using the data lines so as to charge the pixel sub portion of each row of the pixel units in the (2s+2)th set of the detection regions;

after the step of inputting the first data signal to each row of the pixel units in the (2s+2)th set of the detection regions by using the data lines, said method further comprising:

inputting the low voltage level to the first detection line and inputting the high voltage level to the second detection line such that the first thin film transistor and the second thin film transistor of each row of the pixel units in the (2s+2)th set of the detection regions are turned off and the third thin film transistor of each row of the pixel units in the (2s+2)th set of the detection regions is turned on;

inputting a second data signal to each row of the pixel units in the (2s+1)th set of the detection regions by using the data lines so as to check whether or not the brightness of the pixel sub portion of each row of the pixel units in the (2s+2)th set of the detection regions is abnormal and produce a detection result;

wherein the voltage of the first data signal is larger than that of the second data signal.

11. The method according to claim 10, wherein the brightness of the pixel sub portion is compared with a predetermined brightness threshold to produce the detection result.

12. The method according to claim 11, wherein the brightness of the pixel sub portion is abnormal when the detection result indicates that the brightness of the pixel sub portion is greater than the predetermined brightness threshold.

13. The method according to claim 11, wherein the brightness of the pixel sub portion is normal when the detection result indicates that the brightness of the pixel sub portion is less than or equal to the predetermined brightness threshold.

14. The method according to claim 11, wherein the predetermined brightness threshold is an average of the brightness of the pixel sub portions of all the pixel units on the display panel.

* * * * *